United States Patent [19]

Gutweniger

[11] Patent Number: 4,520,955

[45] Date of Patent: Jun. 4, 1985

[54] BUTTON SEWING AID

[76] Inventor: Edgar C. Gutweniger, 5618 N. McVicker Ave., Chicago, Ill. 60646

[21] Appl. No.: 569,296

[22] Filed: Jan. 9, 1984

[51] Int. Cl.[3] ..... A41H 37/10

[52] U.S. Cl. ..... 223/044; 112/110; 112/104; 112/136

[58] Field of Search ..... 223/44; 2/265; 112/104, 112/110, 111, 112, 136, 265.1; 33/190

[56] References Cited

U.S. PATENT DOCUMENTS

| | | | |
|---|---|---|---|
| 1,503,051 | 7/1924 | Kiessling | 112/110 X |
| 2,513,633 | 7/1950 | Folsom | 112/110 X |
| 2,613,446 | 10/1952 | Heimlich | 112/104 X |
| 3,440,984 | 4/1969 | Hofe | 112/110 |
| 4,069,779 | 1/1978 | Klein | 112/136 |
| 4,436,041 | 3/1984 | Taddicken | 112/110 |

*Primary Examiner*—Werner H. Schroeder
*Assistant Examiner*—J. L. Kravitz
*Attorney, Agent, or Firm*—Alan B. Samlan

[57] ABSTRACT

A button sewing aid for use with sewing machines holds various size buttons securely in one position on the fabric during the machine sewing operation. A button holding jig has a groove cut therein, the groove having converging sidewalls which hold and support a button between them. An open channel extends from the front edge of the jig towards the rear edge and terminates at a base portion of the jig adjacent the rear edge. An elongated spacing pin extends from the base portion towards the front edge and is positioned within the open channel. The sew through holes in the button are positioned to lie on either side of the spacing pin.

16 Claims, 6 Drawing Figures

BUTTON SEWING AID

BACKGROUND AND SUMMARY OF THE INVENTION

This invention relates to a device used to position and hold buttons having "sew through" holes which are to be sewn to fabrics or materials by means of a sewing machine.

Buttons come in all shapes and sizes, but actually, there are only two basic types; the sew through and "shank" types. Applicant's invention is directed to a device which aids in positioning and holding a sew through button when it is being sewn with a sewing machine. Most zigzag sewing machines can be used to fasten sew through buttons. However, fastening the sew through buttons with a sewing machine has presented several problems.

The first and most serious problem occurs when the user is attempting to fasten a very small button to the material. These small buttons are frequently encountered on cuffs, shirt collars, blouses, and children's wearing apparel. The button is difficult to keep in place while preparing to stitch it to fabric. One method previously used is to tape the button to the fabric and then stitch through the tape. After the button is stitched, the tape is removed. This is an unacceptable method in that often tape will mar or damage the fabric. Secondly, the tape is not always easily removed from the area between the button and the fabric. Thus, taping is not an acceptable method for holding a button during stitching.

When a button is to be sewn on a fabric, an attachment is installed on the sewing machine, called a button foot which holds the button down against the fabric before, during and after it is stitched. The button foot is generally an L-shaped bracket type device which applies a pressure downward upon the button to hold it in place. The button foot unassisted has generally been found to be unacceptable when trying to hold down very small buttons. The reason is that the button foot is too large and of a configuration that it will not hold the fairly small button down against the material in the exact position during the sewing operation. Rather, the small button tends to slip out from underneath the button foot and can jam the machine or break the needle if it slips out while the needle is reciprocating and sewing. Thus, the button foot has not been found to be acceptable for sewing small buttons.

A second problem encountered when sewing buttons to fabric is providing a space between the bottom of the button and the fabric such that a shank of thread is provided between the button and fabric. The purpose of this shank is to provide a loose fit between the button and fabric. Thus, when the button passes through a button hole on a second piece of material, there is sufficient clearance and freedom of movement of the button to provide easy manipulation and ample spacing of the button for fastening. This problem has been solved in the past by laying a needle, toothpick, or other cylindrical object across the button such that it is positioned between the sew through button holes. It is then stitched simultaneously with the stitching of the button to the fabric. After stitching is completed, the cylindrical object is removed by sliding it out from between the button and thread which thus provides for slack in the thread which is used to form a shank.

A third problem which has been encountered in the past is to provide a means to accurately position a series of buttons the same precise distance from an edge of the fabric. This problem frequently arises when placing buttons along an edge on the front of a shirt or blouse. In the past, the user had to accurately measure the distance from the edge of the fabric and then mark the fabric at the precise distance which the button is to be positioned from the edge. Although this method is satisfactory in providing acccurate placing, it is tedious and time-consuming. It would be advantageous if there was a device which would provide precise and quick placement of a button from an edge of the fabric without the need for marking the fabric.

Another problem has arisen when sewing buttons on fragile fabrics or areas which take a lot of stress. In such applications, it is recommended that a reinforcement button is sewn under the fastening button. Usually a small, flat reinforcing button with the same number of holes is placed underneath the fabric and directly below the fastening button. Then both the fastening button and the reinforcing button are sewn through at the same time. When manually performing such an operation, the user can, after several attempts, generally align the holes in the two buttons so they can be sewn through simultaneously. However, when using a sewing machine, this is not easily done. The reason is that the reinforcing button is not visible under the fabric which has the fastening button placed on top of it. Thus, such a procedure is not normally done on an automatic sewing machine unless alignment of the sew through holes can be guaranteed. Without such alignment, the sewing machine needle will break.

The present invention is directed to a device which is suitable for use with zigzag sewing machines. It provides in a singular device an apparatus which will hold buttons of various sizes, so that they can be accurately positioned and held in that position before and during sewing. Secondly, the device provides for a shank of thread by creating a space between the button and fabric for a loose fit between the two. This provides for easy manipulation of the button when it is to be used for fastening two pieces of fabric by means of a button hole in the second piece. Thirdly, the device provides for the ability to accurately position a button from an edge of the fabric. The selected distance can be repetitively chosen so that consecutive buttons are spaced the same distance from the edge of the fabric. Lastly, the device provides a means to sew a fastening button and a reinforcing button to a fabric simultaneously. The device permits the sew through holes to be aligned and stitched simultaneously without the danger of breaking the needle. Thus, the inventive device accomplishes at least four objectives which are desirable when sewing buttons to fabric using a sewing machine.

According to the embodiments illustrated in the drawings of this application and discussed in detail below, the inventive device comprises a jig which has front and rear edges and a base portion adjacent the rear edge. There is a groove cut in the jig for receiving and holding a button. The groove has converging sidewalls which taper towards each other from the front edge towards the rear edge of the jig. The button is supported by the bottom and sidewalls of the groove. An open channel is cut and extends from the front edge of the jig towards the rear edge and terminates at the base portion. The width of the open channel is at least as wide as the spacing between the sew through holes of the button. There is an elongated pin which is embedded in the base and extends from the base towards the front edge. The pin is centrally located within the open channel.

When a button is to be sewn, it is first placed on the bottom of the groove and slid towards the converging sidewalls until it contacts and is held between the walls. The sew through holes are oriented such that they lie on either side of the pin. The jig is then positioned on the fabric such that the button is oriented directly above the point on the fabric where it is to be fastened. The fabric with the jig is then slid underneath the sewing machine button foot and sewing machine needle. The width of the stitch on the sewing machine needle is set such that the needle will reciprocate between the sew through holes on either side of the pin. The button foot is brought down on the button and the user holds the jig while starting the sewing machine and stitching the button. If the button is of the four sew through hole design, the jig and fabric are merely slid forward into the machine, reorienting the second set of sew through holes underneath the needle, and the procedure repeated. The jig is then slid out from between the button and fabric leaving the button stitched to the fabric. The pin provided an adequate space between the fabric and button such that a shank of thread is formed.

The jig also has graduation marks along its top surface such that it provides for accurate placement of the jig from an edge of the fabric. With these graduations, the jig can be placed the same distance from an edge of the fabric each time a button is sewn thereby providing accurate and consistent positioning of the buttons from an edge.

By turning the jig over, and placing it in its upside down position with a button in the groove, the device can be used for sewing a reinforcing button to a fastening button. One of the buttons is placed in the groove and has its sew through holes properly aligned with the pin. The button and jig is then accurately oriented underneath the sewing machine needle. A piece of fabric is positioned over the jig and button so that the needle will stitch in the proper location on the fabric. The second button is then placed on top of the fabric and underneath the sewing machine needle. Its sew through buttons are visually aligned with the needle and the pin. Thus, the sew through holes on both buttons will be in alignment for simultaneous stitching. Thus, the jig provides for an easy and accurate method of stitching reinforcing buttons to decorative buttons which has heretofore been difficult if not impossible to achieve on a sewing machine.

OBJECT AND ADVANTAGES

It is therefore an object of this invention to provide a button sewing aid for holding buttons having sew through holes while they are being sew by a sewing machine. Related to this object is to provide a device which accurately positions buttons of various sizes, and holds them during stitching.

Another object is to provide a device which will provide for a shank of thread between the button and fabric thus allowing the button to be manipulated for fastening to button holes in other materials. This is desirable and advantageous when sewing buttons for shirts, cuffs and the like.

Yet another object is to provide a button sewing aid which will exactly and accurately position a series of buttons the same distance from an edge of the fabric. This is advantageous for example when sewing buttons in a line on a front of a shirt or blouse.

Still another object is to provide a device which can simultaneously sew a reinforcing button and fastening button on opposite sides of a fabric using a sewing machine. Related to this object is to provide a device which will permit accurate alignment of the sew through holes of the fastening and reinforcing buttons so that they can be stitched simultaneously with a sewing machine.

Many other objects and advantages of the invention will be readily apparent by reference to the accompanying drawings and detailed description of the preferred embodiment.

DETAILED DESCRIPTION OF THE PREFERRED EMBODIMENT

Figure 1:
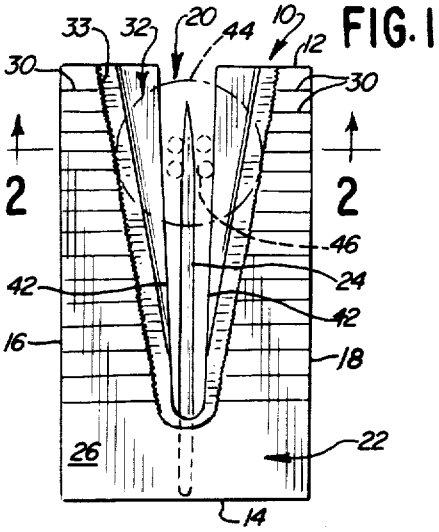
FIG. 1 is a top view of the inventive button holding jig.

Turning first to FIG. 1 there is illustrated a button holding jig 10 which is generally rectangular in shape and has front and rear edges 12, 14 respectively, and opposite side edges 16, 18. The jig 10 has a central opening or channel 20 cut in it, the opening 20 extending from the front edge 12 towards the rear edge 14. The opening 20 terminates at a base portion 22 adjacent the rear edge 14.

Embedded in the base portion 22 is a needle 24 or other generally cylindrical elongated spacing pin or device. The needle 24 extends from the base portion 22 towards the front edge 12 and is generally centrally located within the long axis of the central opening 20.

The jig 10 has top and bottom surfaces 26, 28. As seen in FIG. 1, the top surface 26 has distance markings or graduations 30 on the top surface 26 and extending from the front edge 12 towards the rear edge 14. The markings 30 are precisely measured the same distance from the front edge 12 along both opposite side edges 16, 18. The markings 30 can either be numbered to indicate distance from the front edge 12 or color coded such that the same colored markings are placed the same distance from the edge 12 along the side edges 16, 18.

Cut in the top surface 26 is a groove or chute 32. The groove 32 can best be seen by looking at FIGS. 1–3. The groove 32 is cut into the top surface 26 but does not pass through the jig 10 all the way to the bottom surface 28. The groove is defined by a bottom and converging sidewalls 33. The groove 32 is formed in two general areas. The first area is formed from the front edge 12 to approximately two-thirds of the way towards the base portion 22, there are converging curved sides 34 which connect a flat bottom 36 to a horizontal plateau or ledge 38. The top surface 26 is connected to the horizontal plateau 38 by vertical walls 40. The plateau or ledge 38 surrounds the groove 32 on all sides except the front 12. The flat bottom 36 extends from the front edge 12 to approximately one-half the distance from the front edge 12 towards the base 22. The flat bottom 36 spans the area between the curved sides 34. In a transition area 42 the curved sides 34 merge with the central opening 20. The second area is formed by the horizontal plateau 38 as it continues down towards the base 22 and surrounds the bottom of the central opening 20. Additionally, the curved sides 34 and vertical walls 40 are provided with knurling or a roughening of their surfaces to aid in grabbing and holding a button 44 which is to be sewn.

Figure 2:
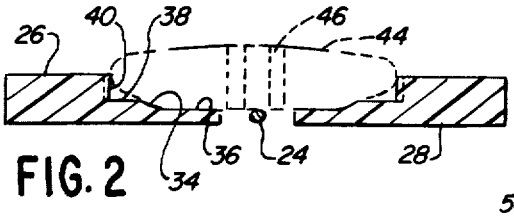
FIG. 2 is a cross sectional view taken along line 2—2 of FIG. 1 and illustrates the orientation of a button illustrated in fanthom, when placed in the groove.

The sides 34 and walls 40 converge or are tapered toward each other from the front edge 12 towards the base portion 22. This provides for receiving and holding buttons 44 of different sizes. Larger diameter buttons 44 tend to be designed with curved bases. Thus, these larger diameter buttons will be accommodated and fit between the vertical walls 40, curved sides 34 and the flat bottom 36 as seen in FIG. 2. Larger flat buttons would be retained between the vertical walls 40 and the horizontal plateau 38 but would not contact the curved sides 34. Smaller diameter buttons 44 tend to have flat bottoms and would fit between the vertical walls 40 and are supported by the horizontal plateau 38 in the lower portion of the groove 32 towards the base 22.

Figure 3:
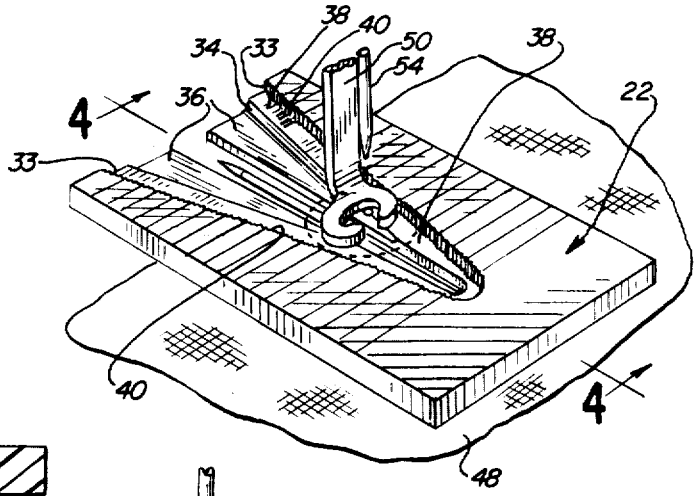
FIG. 3 is a perspective view with portions removed of the inventive jig with a button placed underneath the button foot of a sewing machine and illustrates the orientation of the inventive device with respect to the sewing machine button foot and sewing machine needle.

The inventive button holding device is designed to hold buttons having sew through holes as illustrated in FIGS. 1-3. Particularly, as seen in FIGS. 1 and 2, the button 44 has four sew through holes 46. Other buttons may have just two sew through holes (one pair) but applicant's device will work with either type of buttons 44. The positioning of the button 44 within the groove 32 is such that one of the sew through holes 46 of each pair are positioned on either side of the needle 24 as illustrated in FIG. 2.

Figure 4:
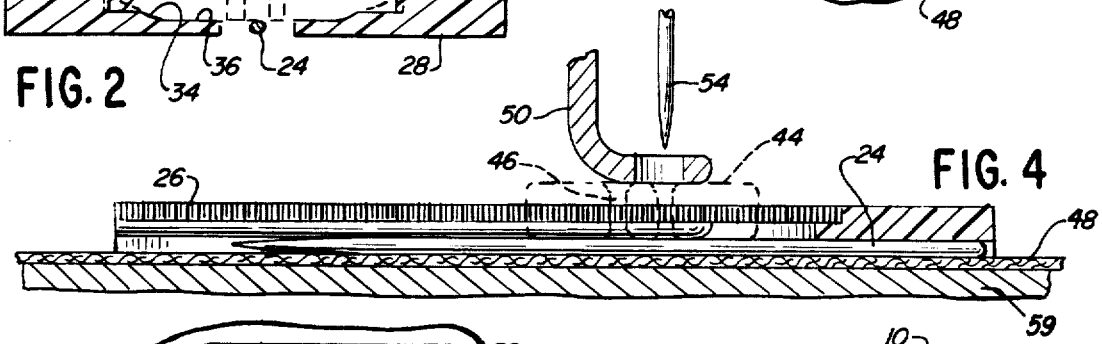
FIG. 4 is a cross sectional view taken along line 4—4 of FIG. 3 and illustrates the button foot holding the button down just before stitching has begun.

In order to sew the button 44 onto a piece of fabric 48 the following procedure is used. The button 44 is slid in the groove 32 until it engages and is held between either the sides 34 and for the vertical walls 40 as seen in FIG. 2. Each of the sew through holes 46 of a pair are positioned on either side of the needle 24. The jig 10 with the button 44 held in it, is then placed on the fabric 48 with the button 44 positioned above the exact location to which it is to be stitched. The jig 10 and fabric 48 are then slid together on a sewing machine working top surface 59 (FIG. 4), underneath the sewing machine head (not illustrated). A button foot 50 which is standardly available and is utilized to hold buttons down during machine stitching, (FIGS. 3 and 4) is lowered by the machine operator by lowering a lever. This holds the button 44 against the jig 10 and in proper position. The bottom surface 28 of the jig 10 is striated with score lines 52 such that it will not slip on the fabric 48. It can be seen that regardless of the size of the button 44, the button foot 50 will securely hold the button 44 within the groove 32. Heretofore, the button 44 could tilt, or slip out from underneath the button foot 50 during stitching.

With the button foot 50 holding the button 44 in place, the operator sets the distance or width which a sewing machine needle 54 is to reciprocate between such that the machine needle will stitch only between one pair of holes 46. This is done by manually moving the sewing machine needle 54 slowly between the sew through holes 46 and setting the distance. The machine is then automatically operated to stitch between one set of sew through holes 46 the appropriate number of times such that the button will be held to the fabric. If the button is of the type illustrated in FIG. 1 and has two pairs or four sew through holes, the jig is then merely pushed forward or backward until the next pair of sew through holes 46 are aligned under the sewing machine needle 54. The sewing procedure is repeated and the button 44 is thus fastened to the fabric 48.

The jig 10 also can be used to position a series of buttons all the same distance from an edge of the material. This is accomplished by placing one button its proper distance from the material's edge. The marking 30 which lines up with the edge is noted. By placing the jig 10 with the same marking 30 aligned with the material edge for subsequent buttons of the same size, each button will repeatedly be located the same distance from the edge. Thus, the buttons will be fastened in a straight line from the edge.

It can be seen that the needle 24 will be stitched between the fabric 48 and the button 44. When the jig 10 is slid out from between the button and fabric, the needle 24 will also be removed. This provides a spacing or gap between the button 44 and the material 48. Thus, because of the gap the thread holding the button to the fabric will have slack in it which provides a shank between the button and material. This shank provides for flexibility in manipulating the button when fastening two pieces of cloth or material together by means of the button and its respective button hole. It also provides a space in which to receive the other piece of material.

The needle 24 can be embedded in the base portion 22 by screwing the needle 24 into a threaded hole in the base portion 22. Thus, the needle 24 would be removable should the user not desire any slack in the thread. Thus, a shank of thread and loose fastening of the button to the material would not be provided for. This technique is used when buttons are sewn on the surface of garments as decoration only.

Figure 5:
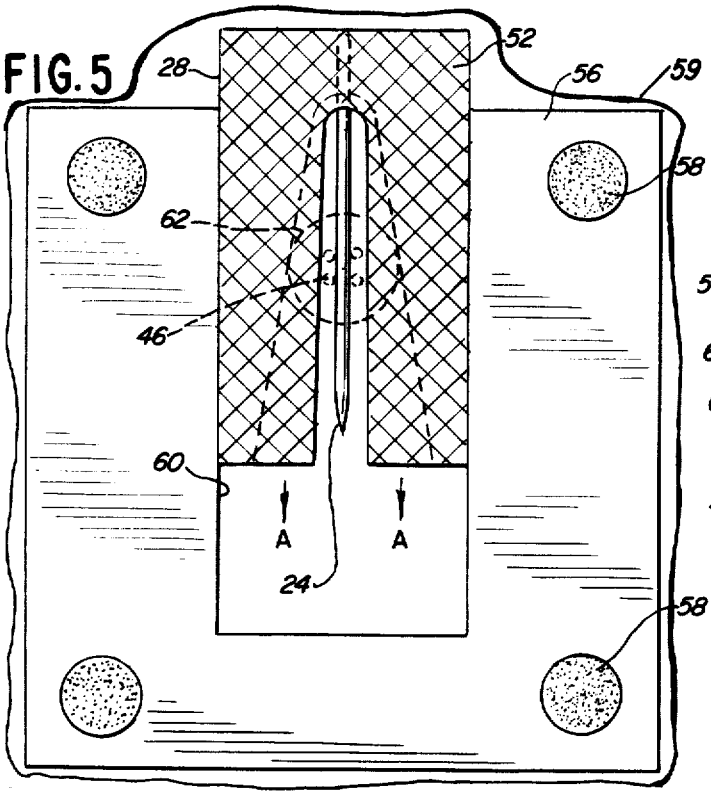
FIG. 5 is a top view with portions removed of the button holding jig with its bottom side up and placed in a fixture for use when sewing a fastening and reinforcing button to a piece of fabric.
Figure 6:
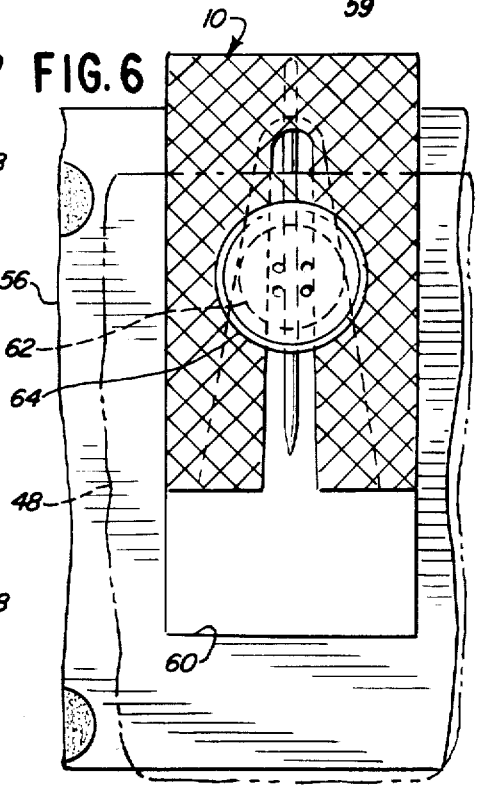
FIG. 6 is similar to FIG. 5 illustrating the positioning of the fabric and the two buttons with respect to the button holding jig when simultaneously sewing a reinforcing button and fastening button to the piece of fabric.

FIGS. 5 and 6 illustrate an alternate use for the button holding jig 10. It is particularly useful for stitching a fastening button to a piece of material with a reinforcing button underneath it and on the opposite side of the material. A fixture 56 is fastened by means of screws 58 to the sewing machine cover plate 59 which is the working top surface of the sewing machine on which the material is placed when it is to be sewn. The fixture 56 has a rectangular opening 60 which is dimensioned to closely receive the jig 10 as illustrated in FIG. 5. The fixture 56 is positioned on the sewing machine cover plate such that the long axis of the rectangular opening 60 is directly beneath the center of the button foot 50. Furthermore, the fixture 56 should be located by way of screws 58 such that the button foot 50 will be towards the open end of the rectangular opening 60 when the button foot 50 is lowered.

With the fixture 56 accurately fastened beneath the button foot 50 the procedure is as follows. The jig 10 is turned over such that the bottom surface 28 is now the exposed top surface. A smaller rectangular button 62 is placed within the groove 32 similar to as described above. Again the sew through holes 46 must be positioned on either side of the needle 24. The jig 10 is then slid into the rectangular opening 60 in the direction of the arrows A until the button 62 is in position directly underneath the button foot. When the sewing machine needle 54 comes down it will stitch through the desired sew through holes 46.

The material or fabric 48 is then layed over the jig 10 which has button 62 in the groove 32. The material is positioned such that the needle will stitch through the exact location where the buttons are to be fastened. (See FIG. 6). A second larger button 64 is then placed on top of the fabric 48 with the sew through holes 46 of the button 64 in alignment with the sewing machine needle 54. This necessarily means that the sew through holes of both buttons 62 and 64 are in alignment with each other. The machine then automatically stitches as previously described. The only difference between this and the previous procedure is that both buttons 62 and 64 are simultaneously stitched to each other with the fabric 48 sandwiched between them. Again, the needle 24 provides the spacing to form a shank of thread.

Thus, it is apparent that there has been provided in accordance with the invention, a button sewing aid for sewing machines that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A button sewing aid for holding buttons having sew through holes comprising:

a button holding jig having front and rear edges and a base portion adjacent the rear edge, a groove in the jig for receiving a button, the groove being open at the front edge and having a bottom and sidewalls, the sidewalls converging towards each other from the front edge towards the rear edge, the button received between the converging sidewalls and upon the bottom of the groove, an open channel extending from the front edge towards the rear edge and terminating at the base portion, the width of the open channel being at least as wide as the space between the sew through holes of the button, an elongated pin extending from the base portion towards the front edge and disposed within the open channel and parallel to the long axis of the channel with the button positioned so that the sew through holes in the button lie on either side of the pin with the pin disposed between the material and the button to provide a shank of thread therebetween after the button is sewn and the jig removed, whereby the button is held by the jig in its proper position adjacent the material during stitching with the jig being removed after the button is sewn to the material.

2. The button sewing aid of claim 1 wherein the sidewalls of the groove have their surfaces knurled to provide for improved gripping of the button by the sidewalls.

3. The button sewing aid of claim 1 and further comprising top and bottom surfaces on the jig wherein a portion of the sidewalls is formed by a flat horizontal ledge connected to the top surface by vertical walls, with the flat horizontal ledge adjacent to at least the base portion.

4. The button sewing aid of claim 3 wherein the sidewalls of the groove adjacent the front edge curve upward from the bottom of the groove to receive a button having a curved bottom, and the sidewalls of the groove adjacent the base are vertical with the horizontal ledge adapted to receive a button having a flat bottom.

5. The button sewing aid of claim 3 wherein the sidewalls converge at the base portion in a U-shaped configuration.

6. The button sewing aid of claim 1 wherein the bottom surface on the jig is striated to provide for non-slippage between the jig and the material.

7. The button sewing aid of claim 1 wherein the top surface on the jig has distance markings thereon to provide accurate, repetitive placement of the jig from an edge of the material thereby providing consistent spacing of the buttons from the material's edge.

8. The button sewing aid of claim 1 wherein the elongated pin is removably held by the base portion.

9. A button sewing aid for use with sewing machines having a sewing surface which supports a material to which the buttons are to be sewn, the aid comprising:

a button holding jig having front and rear edges and a base portion adjacent the rear edge, a groove in the jig for receiving a button, the groove being open at the front edge and having a bottom and sidewalls, the sidewalls converging towards each other from the front edge towards the rear edge, the button received between the converging sidewalls and upon the bottom of the groove, an open channel extending from the front edge towards the rear edge and terminating at the base portion, the width of the open channel being at least as wide as the space between the sew through holes of the button, a fixture adapted to receive and hold the jig, locating means on the machine sewing surface to accurately position the fixture on the sewing surface under a machine sewing needle, an elongated pin extending from the base portion towards the front edge and disposed within the open channel and parallel to the long access of the channel with the button positioned so that the sew through holes in the button lie on either side of the pin with the pin disposed between the material and the button to provide a shank of thread therebetween after the button is sewn and the jig removed, whereby the jig can be positioned under the material with a first button in the groove and a second button placed on top of the material with its sew through holes aligned with the sew through holes of the first button so that both buttons can be stitched to the material and to each other simultaneously.

10. The button sewing aid of claim 9 wherein the sidewalls of the groove have their surfaces knurled to provide for improved gripping of the button by the sidewalls.

11. The button sewing aid of claim 9 and further comprising top and bottom surfaces on the jig wherein a portion of the sidewalls is formed by a flat horizontal ledge connected to the top surface by vertical walls, with the flat horizontal ledge adjacent to at least the base portion.

12. The button sewing aid of claim 11 wherein the sidewalls of the groove adjacent the front edge curve upward from the bottom of the groove to receive a button having a curved bottom, and the sidewalls of the groove adjacent the base are vertical with the horizontal ledge adapted to receive a button having a flat bottom.

13. The button sewing aid of claim 11 wherein the sidewalls converge at the base portion in a U-shaped configuration.

14. The button sewing aid of claim 9 wherein the bottom surface on the jig is striated to provide for non-slippage between the jig and the material.

15. The button sewing aid of claim 9 wherein the top surface on the jig has distance markings thereon to provide accurate, repetitive placement of the jig from an edge of the material thereby providing consistent spacing of the buttons from the material's edge.

16. The button sewing aid of claim 9 wherein the elongated pin is removably held by the base portion.

* * * * *